US008376086B1

(12) United States Patent
Moyer

(10) Patent No.: US 8,376,086 B1
(45) Date of Patent: Feb. 19, 2013

(54) SAFETY NET

(76) Inventor: Rosalina R. Moyer, Washington, PA (US)

( * ) Notice: Subject to any disclaimer, the term of this patent is extended or adjusted under 35 U.S.C. 154(b) by 226 days.

(21) Appl. No.: 12/858,016

(22) Filed: Aug. 17, 2010

(51) Int. Cl.
*E04G 21/32* (2006.01)

(52) U.S. Cl. ..... 182/138

(58) Field of Classification Search ..... 182/129, 182/138, 45
See application file for complete search history.

(56) References Cited

U.S. PATENT DOCUMENTS

| | | | | |
|---|---|---|---|---|
| 1,546,399 | A * | 7/1925 | Moylan | 182/82 |
| 3,949,834 | A | 4/1976 | Nusbaum | |
| 4,119,176 | A | 10/1978 | Verdu | |
| 4,732,234 | A | 3/1988 | Brickman | |
| 4,838,382 | A * | 6/1989 | Nusbaum | 182/138 |
| 5,083,636 | A * | 1/1992 | Goldenberg | 182/138 |
| 5,299,654 | A * | 4/1994 | Duncan | 182/138 |
| 5,429,206 | A * | 7/1995 | Nusbaum | 182/138 |
| 5,862,880 | A * | 1/1999 | Nelson et al. | 182/45 |
| 6,305,310 | B1 * | 10/2001 | Ferri | 114/343 |
| 6,485,373 | B1 * | 11/2002 | Stephens | 473/197 |
| 7,503,372 | B1 | 3/2009 | Jones | |
| 7,726,081 | B1 * | 6/2010 | Bennardo et al. | 52/222 |
| 2006/0180390 | A1 | 8/2006 | Thaler | |

FOREIGN PATENT DOCUMENTS

| | | | |
|---|---|---|---|
| FR | 2442320 | * | 6/1980 |
| JP | 07102785 A | * | 4/1995 |
| JP | 07259348 A | * | 10/1995 |
| JP | 07300960 A | * | 11/1995 |

* cited by examiner

*Primary Examiner* — Katherine Mitchell
*Assistant Examiner* — Kristine Florio

(57) ABSTRACT

A safety net designed to prevent roofers from falling off a roof includes a pair of plates disposed on each side of the roof, a vertical support member attached to each plate, and a horizontal support member perpendicular to each vertical support member. The horizontal support members have one end pivotally attached to the plate and another end attached respective front edges of a net. Respective rear edges of the net are attached to a pair of eye bolts disposed on the soffit proximate left and right sides of the roof. A pair of steel cables, each having one end attached to an S-hook attached to an eye bolt, are attached to the side edges of the roof, and the opposing cable ends are attached to an eye bolt disposed on an outer end of each horizontal support member. The cables work in conjunction with the horizontal and vertical support members to maintain the net in a position extending outwardly across the front side of the roof directly beneath the soffit.

2 Claims, 3 Drawing Sheets

SAFETY NET

BACKGROUND OF THE INVENTION

Various types of safety net devices are known in the prior art. However, what is needed is portable detachable safety net which attaches to the soffit along a roof to prevent a person from falling off a roof.

FIELD OF THE INVENTION

The present invention relates to safety net devices, and more particularly, to a safety net which has a stable, portable, and detachable support assembly to which a net is attached to a soffit along a front side of a roof.

SUMMARY OF THE INVENTION

The general purpose of the present safety net, described subsequently in greater detail, is to provide a safety net which has many novel features that result in a safety net which is not anticipated, rendered obvious, suggested, or even implied by prior art, either alone or in combination thereof.

To accomplish this, the present safety net is utilized in combination with a structure's roof having a soffit to prevent a roof worker from falling off the roof. The safety net is a portable device that is installed by attaching the device to the soffit of a pitched roof structure. The present safety net includes a pair of thin parallelepiped plates, each being removably attached to a side edge of the roof. A cylindrical vertical support member is attached to each plate parallel to the structure exterior side wall and a cylindrical horizontal support member is pivotally attached to each plate in a position perpendicular to the vertical support member. A first eye bolt is disposed on the vertical support member top end while a second eye bolt is disposed on the horizontal support member outer end and a third eye bolt is disposed on the soffit at a 45-degree angle to the vertical support member. An S-hook has a first end attached to the third eye bolt.

A continuous steel cable has a first adjustable loop disposed on a first outer end of the cable which attaches to a second end of the S-hook and a first hook disposed on a cable second outer end of the cable, which releasably attaches to the second eye bolt. A fourth eye bolt attaches to the soffit on each roof side.

A heavy-duty net has a second hook disposed on a front edge proximal to each of the first edge and the second edge of the net. Each second hook releasably attaches to the second eye bolt. A third hook, which is disposed on the net rear edge proximal to each of the first edge and the second edge, releasably attaches to the fourth eye bolt.

In another embodiment of the present safety net, a heavy-duty net which also has a hem along each of the net's first and second edges and a plurality of grommets disposed along the net's front and rear edges are included. In this embodiment each cable has a first adjustable loop disposed on a first outer end which attached to the S-hook second end and a second adjustable loop disposed on a second outer end. Each cable slidingly engages one of the hems and the second adjustable loop is attached to the fourth eye bolt. The grommets of one net interconnect with the grommets of another net to allow several nets to be conjoined and connected to the roof.

Yet another embodiment of the present safety net includes a pair of heavy-duty nets each having binding disposed along each of the first and second edges as well as a plurality of grommets disposed along the hem along the front edge of one net and along the rear edge of the other net. This embodiment includes a continuous steel cable having the first adjustable loop disposed on the first outer end and the second adjustable loop disposed on a cable second outer end. An S-hook 40 is removably attached to the first adjustable loop and the second adjustable loop. The hem 64 of one of the nets overlaps the hem of the other net and the grommets of each net align. The cable slidingly engages the aligned grommets to conjoin the nets. The S-hook attached to the first adjustable loop attaches to the hem on one of the net first and second edges. The second adjustable loop attaches to the fourth eye bolt on one of the roof sides. A number of nets may thus be conjoined to fit across the front side of a wide range of roof widths. In this embodiment the net has a width of approximately 6 feet and a length of approximately 6 feet.

The instant safety net may be moved and used an unlimited number of times for use on different roofs.

Thus has been broadly outlined the more important features of the present safety net so that the detailed description thereof that follows may be better understood and in order that the present contribution to the art may be better appreciated.

BRIEF DESCRIPTION OF THE DRAWINGS FIGURES

DETAILED DESCRIPTION OF THE DRAWINGS

Figure 1:
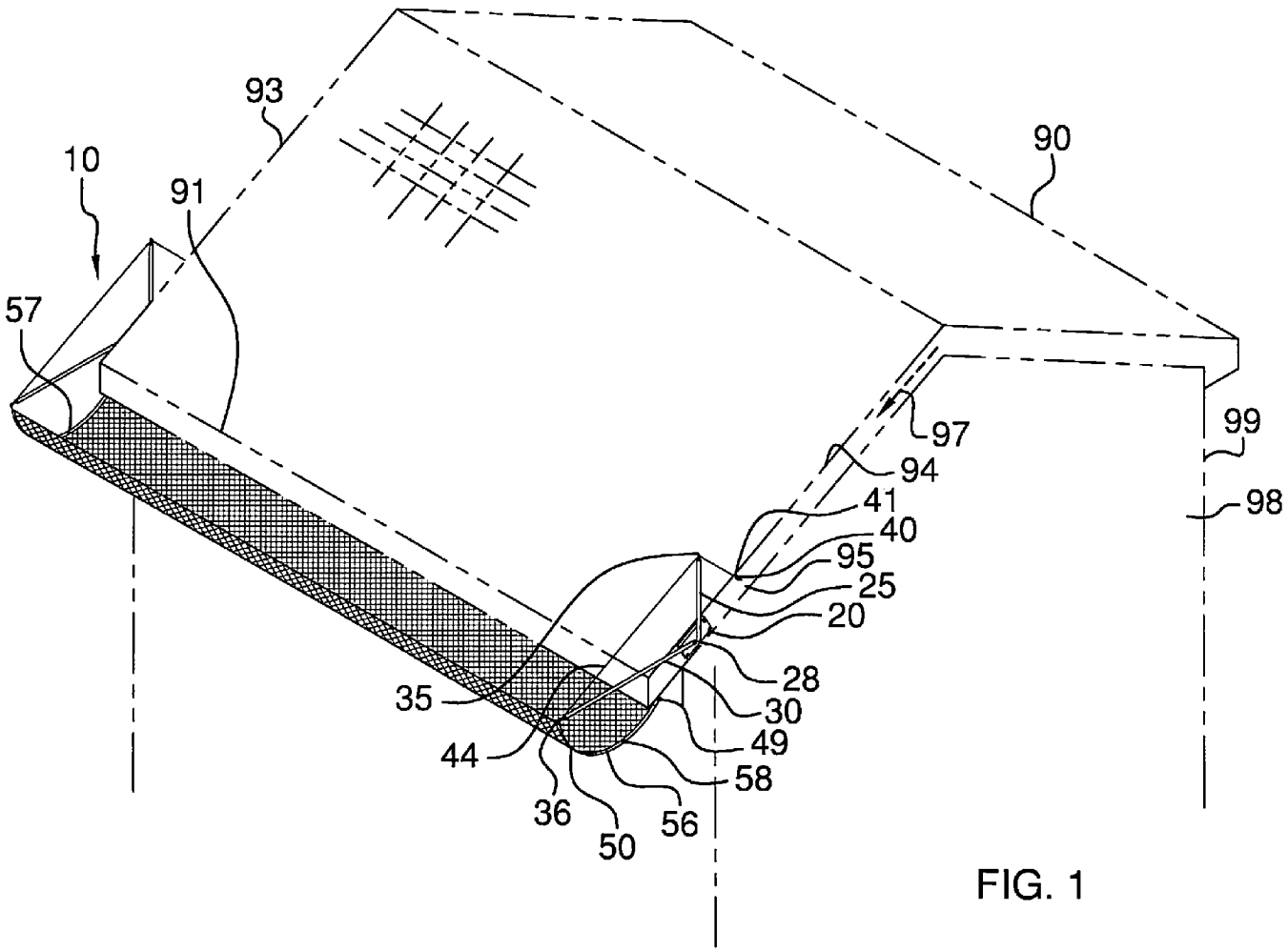
FIG. 1 is an in-use isometric view.
Figure 2:
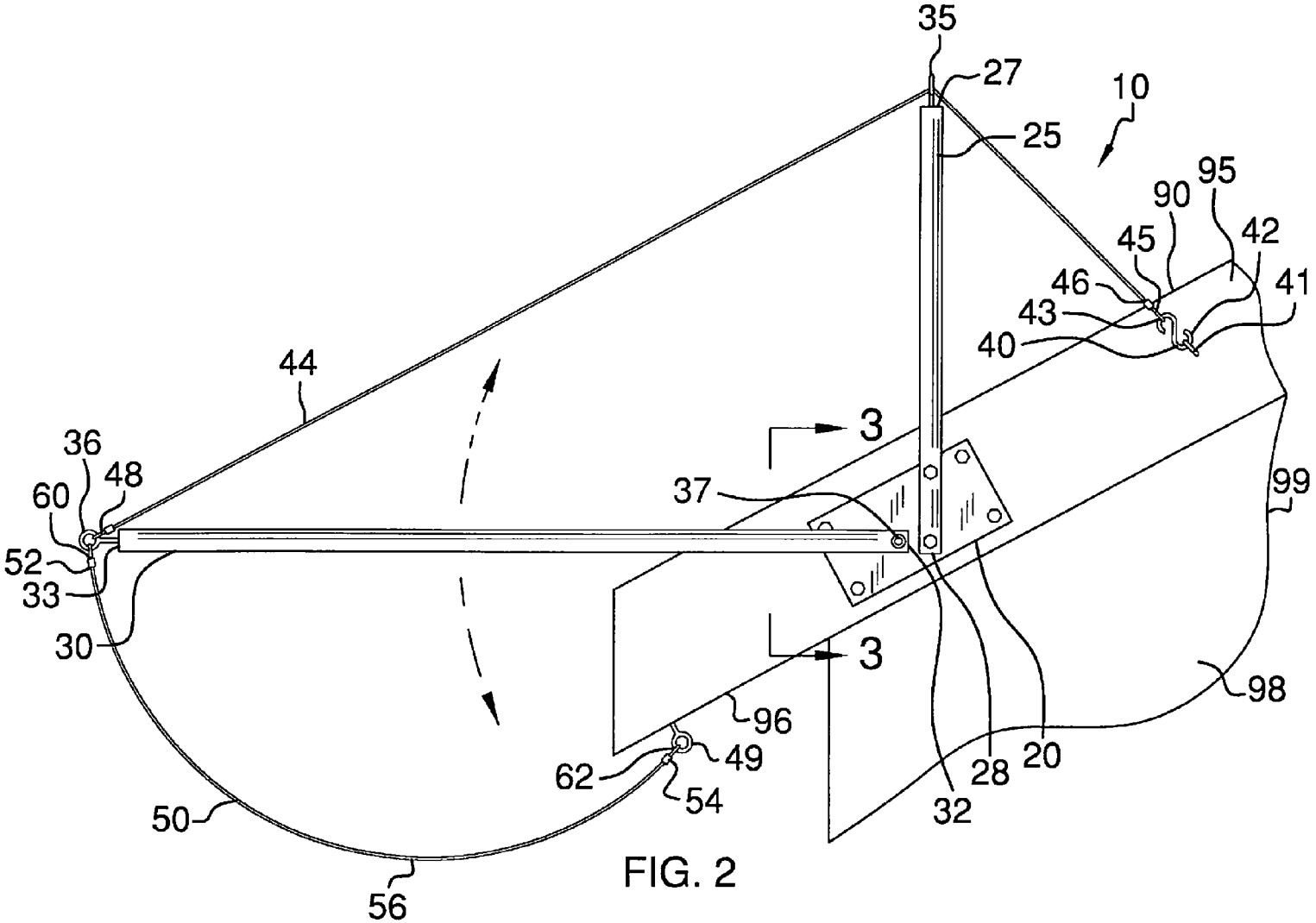
FIG. 2 is a side elevation view.
Figure 4:
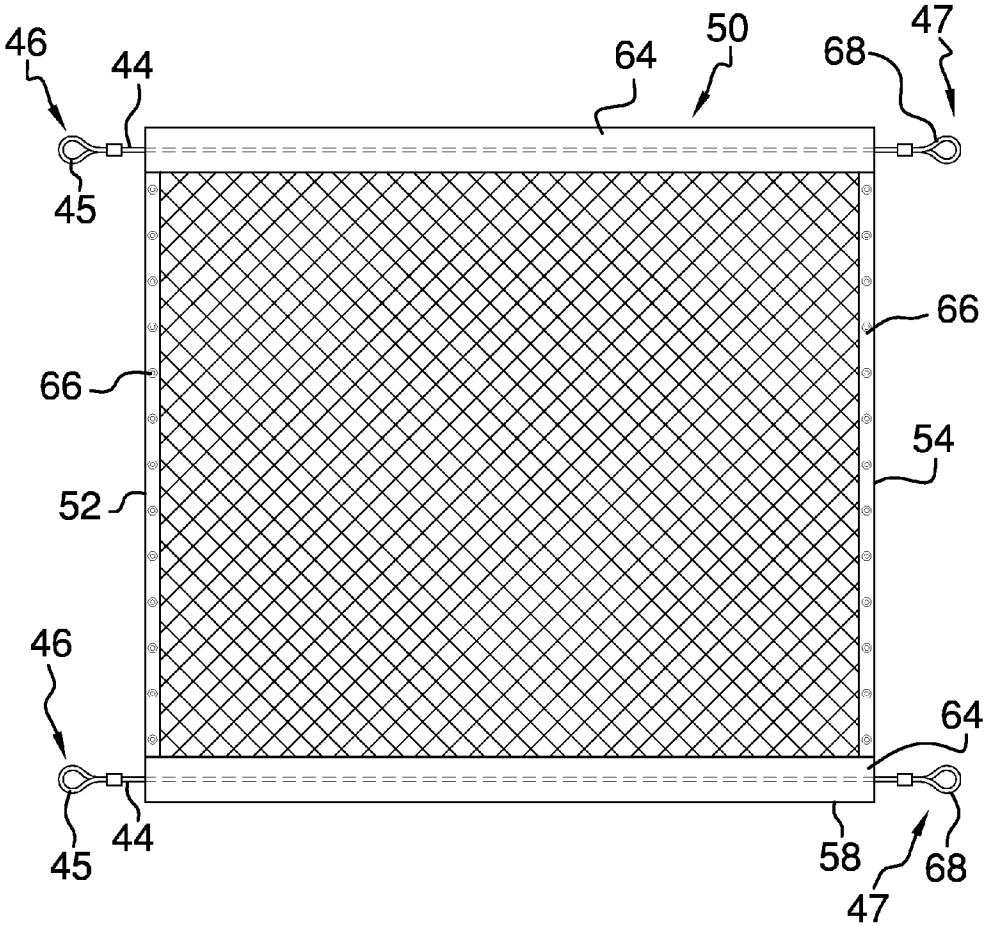
FIG. 4 is a top plan view of an alternative embodiment of a net.
Figure 3:
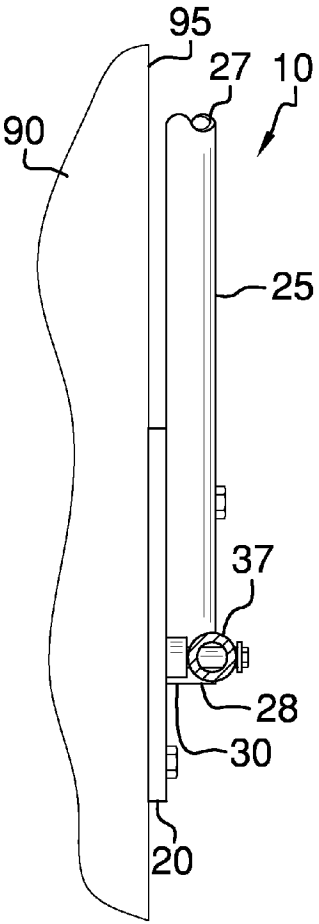
FIG. 3 is a cross-section view taken along line 3-3 of FIG. 2.

With reference now to the drawings, and in particular FIGS. 1 through 3 thereof, example of the instant safety net employing the principles and concepts of the present safety net and generally designated by the reference number 10 will be described.

Referring to FIGS. 1 through 3 a preferred embodiment of the present safety net 10 is illustrated. The safety net 10 is utilized in combination with a roof 90 over a structure 99 having an exterior side wall 98. The roof 90 has a front side 91, a left side 93, a right side 94, a soffit 96, and side edges 95 extending downwardly from the roof along the left side 93 and the right side 94.

The safety net 10 includes a pair of thin parallelepiped plates 20. One plate 20 is removably attached to the side edge 95 on the left side 93 proximal to the front side 91. The other plate 20 is removably attached to the side edge 95 on the right side 94 proximal to the front side 91. Each plate 20 is attached in a position parallel to a fall line 97 of the respective side edge 95. A cylindrical vertical support member 25, which has a top end 27 and a bottom end 28, is removably attached to each of the plates 20 in a position parallel to the structure 99 exterior side wall 98. A cylindrical horizontal support member 30, having an inner end 32 and a first outer end 33, is removably attached to each of the plates 20 in a position perpendicular to the vertical support member 25. A pivot ring 37 pivotally attaches the horizontal support member 30 to each of the plates 20. The pivotal attachment permits adjustability to accommodate varying roof pitches.

A first eye bolt 35 is disposed on the vertical support member 25 top end 27. A second eye bolt 36 is disposed on the horizontal support member 30 outer end 33. A third eye bolt 41 is disposed on the side edge 95 at a 45-degree angle to the vertical support member 25. The present safety net includes an S-hook 40 having a first end 42 and a second end 43. The first end 42 is attached to the third eye bolt 41.

The present safety net 10 also includes a continuous steel cable 44. The cable 44 has a first adjustable loop 45 disposed on a first outer end 46 of the cable 44 and a first hook 48 disposed on a second outer end 47 of the cable 44. The first adjustable loop 45 removably attaches to the S-hook 40 second end 43. The first hook 48 releasably attaches to the second eye bolt 36. At each end of the net 10, a fourth eye bolt 49 is attached to the soffit 96 on each of the left side 93 and the right side 94.

A heavy-duty net 50 is also included. The net 50 has a front edge 52, a rear edge 54, a first edge 56, and a second edge 57 as well as a binding 58 disposed along each of the first edge 56 and the second edge 57. A second hook 60 is disposed on the net 50 front edge 52 proximal to each of the first edge 56 and the second edge 57. Each second hook 60 is releasably attached one of the second eye bolts 36. A third hook 62 is disposed on the net 50 rear edge 54 proximal to each of the first edge 56 and the second edge 57. Each third hook 62 releasably attaches to one of the fourth eye bolts 49. The cable 44 working in conjunction with the horizontal and vertical support members 25, 30 maintains the net 50 in a position continuously extending outwardly across the front side 91 of the roof 90 from directly beneath the soffit 96. The adjustability of the first loop 45 allows the length of the cable 44 to be adjusted, thus allowing the safety net 10 to be installed on either a one-story or a two-story building having different pitches. The net 50 has a semicircular cross-section as viewed from a side view upon installation thus preventing a roof worker from falling off the front edge 52 of the net 50.

Another embodiment of the present safety net 10 includes a heavy-duty net 50 which also has a hem 64 along each of the first edge 56 and the second edge 57 of the net 50 and a plurality of spaced apart grommets 66 continuously disposed along each of the net 50 front edge 52 and the net 50 rear edge 54. In this embodiment each cable 44 has a first adjustable loop 45 disposed on a first outer end 46 and a second adjustable loop 68 disposed on a second outer end 47. The first adjustable loop 45 removably attaches to the S-hook 40 second end 43. Each of the cables 44 slidingly engages one of the hems 64 and the second adjustable loop 68 is attached to the fourth eye bolt 49 disposed on one of the roof 90 left side and the roof 90 right side. The grommets 66 of one net 50 interconnect with grommets 66 of another net 50 to allow several nets 50 to be conjoined.

What is claimed is:

1. A safety net utilized in combination with a roof over a structure having an exterior side wall, the roof having a front side, a left side, a right side, a soffit, and side edges extending downwardly from the roof along the left side of the roof and the right side of the roof, the safety net comprising:

a pair of thin parallelepiped plates, each being removably attached to a respective one of the side edges on the left side of the roof proximal to the front side of the roof and on the right side of the roof proximal to the front side of the roof in a position parallel to a fall line of the respective side edge of the roof;

a pair of cylindrical vertical support members, each vertical support member being removably attached to a respective one of the plates in a position parallel to the structure exterior side wall, each vertical support member having a top end and a bottom end;

a pair of cylindrical horizontal support members, each horizontal support member being removably attached to a respective one of the plates in a position perpendicular to the vertical support member attached to the respective plate, each horizontal support member having an inner end and an outer end;

a pair of pivot rings, each pivot ring being pivotally attaching a respective one of the horizontal support members to the respective one of the plates;

a pair of first eye bolts, each first eye bolt being disposed on the top end of a respective one of the vertical support members;

a pair of second eye bolts, each second eye bolt being disposed on the outer end of a respective one of the horizontal support members;

a pair of third eye bolts, each third eye bolt being disposed on a respective one of the side edges of the roof at a 45-degree angle to the respective vertical support member;

a pair of S-hooks, each S-hook having a first end and a second end, the first end of each S-hook being attached to a respective one of the third eye bolts;

a pair of continuous steel cables, each cable having a first adjustable loop disposed on a first outer end of the cable and a first hook disposed on a second outer end of the cable, the first adjustable loop removably attached to the second end of a respective one of the S-hooks, the first hook releasably attached to a respective one of the second eye bolts;

a pair of fourth eye bolts, each fourth eye bolt being attached to the soffit proximate a respective one of the left side of the roof and the right side of the roof;

a heavy-duty net having a front edge, a rear edge, a first edge, and a second edge and further having binding disposed along each of the first edge and the second edge;

a pair of second hooks, each second hook being disposed on the net front edge proximal to a respective one of the first edge and the second edge, each of the second hooks being releasably attached to an associated one of the second eye bolts; and a pair of third hooks, each third hook being disposed on the net rear edge proximal to a respective one of the first edge and the second edge, each of the third hooks being releasably attached to an associated one of the fourth eye bolts;

wherein each cable in conjunction with the respective horizontal and vertical support members maintains the net in a position extending outwardly continuously across the front side of the roof extending from beneath the soffit.

2. A safety net utilized in combination with a roof over a structure having an exterior side wall, the roof having a front side, a left side, a right side, a soffit, and side edges extending downwardly from the roof along the left side of the roof and the right side of the roof, the safety net comprising:

a pair of thin parallelepiped plates, each being removably attached to a respective one of the side edges on the left side of the roof proximal to the front side of the roof and on the right side of the roof proximal to the front side of the roof in a position parallel to a fall line of the respective side edge of the roof;

a pair of cylindrical vertical support members, each vertical support member being removably attached to a respective one of the plates in a position parallel to the structure exterior side wall, each vertical support member having a top end and a bottom end;

a pair of cylindrical horizontal support members, each horizontal support member being removably attached to a respective one of the plates in a position perpendicular to the vertical support member attached to the respective plate, each horizontal support member having an inner end and an outer end;

a pair of pivot rings, each pivot ring being pivotally attaching a respective one of the horizontal support members to the respective one of the plates;

a pair of first eye bolts, each first eye bolt being disposed on the top end of a respective one of the vertical support members;

a pair of second eye bolts, each second eye bolt being disposed on the outer end of a respective one of the horizontal support members;

a pair of third eye bolts, each third eye bolt being disposed on a respective one of the side edges of the roof at a 45-degree angle to the respective vertical support member;

a pair of S-hooks, each S-hook having a first end and a second end, the first end of each S-hook being attached to a respective one of the third eye bolts;

a pair of fourth eye bolts, each fourth eye bolt being attached to the soffit proximate a respective one of the left side of the roof and the right side of the roof;

a heavy-duty net having a front edge, a rear edge, a first edge, and a second edge and further having binding disposed along each of the first edge and the second edge;

a hem disposed along each of the first edge and the second edge of the net;

a plurality of spaced apart grommets continuously disposed along each of the net front edge and the net rear edge; and a pair of continuous steel cables, each cable having a first adjustable loop disposed on a first outer end of a respective one of the cables and a second adjustable loop disposed on a second outer end of the respective one of the cables, the first adjustable loop of each cable is removably attached to the second end of an associated one of the S-hooks, wherein each of the cables slidingly engages the net hem on a respective one of the first edge and the second edge of the net and further wherein each second adjustable loop is attached to an associated one of the fourth eye bolts.

* * * * *